United States Patent [19]

Hamano

[11] Patent Number: 4,843,437

[45] Date of Patent: Jun. 27, 1989

[54] COPYING MACHINE

[75] Inventor: Hiroaki Hamano, Osaka, Japan

[73] Assignee: Minolta Camera Kabushiki Kaisha, Osaka, Japan

[21] Appl. No.: 192,532

[22] Filed: May 11, 1988

[30] Foreign Application Priority Data

May 15, 1987 [JP] Japan ..... 62-119749

[51] Int. Cl.[4] ..... G03G 15/00

[52] U.S. Cl. ..... 355/206; 355/308

[58] Field of Search ..... 355/14 SH, 14 R, 3 SH, 355/3 DR, 75

[56] References Cited

U.S. PATENT DOCUMENTS

| | | | |
|---|---|---|---|
| 3,863,912 | 2/1975 | Korff | 271/245 |
| 4,099,860 | 7/1978 | Connin | 355/14 R |
| 4,264,188 | 4/1981 | Tomosada et al. | 355/14 R |
| 4,508,444 | 4/1985 | May et al. | 355/14 SH |
| 4,545,668 | 10/1985 | Zaitsu | 355/14 SH |
| 4,551,009 | 11/1985 | Shigemura et al. | 355/14 SH |
| 4,711,550 | 12/1987 | Sumida et al. | 355/14 SH |
| 4,751,552 | 6/1988 | Itoigawa | 355/14 SH |

*Primary Examiner*—R. L. Moses

*Attorney, Agent, or Firm*—Burns, Doane, Swecker & Mathis

[57] ABSTRACT

The disclosure relates to a copying machine in which a document is continuously transported to obtain a copy image with an exposure device fixed. The machine comprises a first unit for forming an image of a document on copy paper, a second unit provided so as to be capable of opening and closing relative to the first unit and including document transport rollers and a motor for driving said rollers and a sensor for detecting abnormal operation of the motor.

When the second unit is detected to be opened, the detecting operation of the sensor is inhibited.

3 Claims, 8 Drawing Sheets

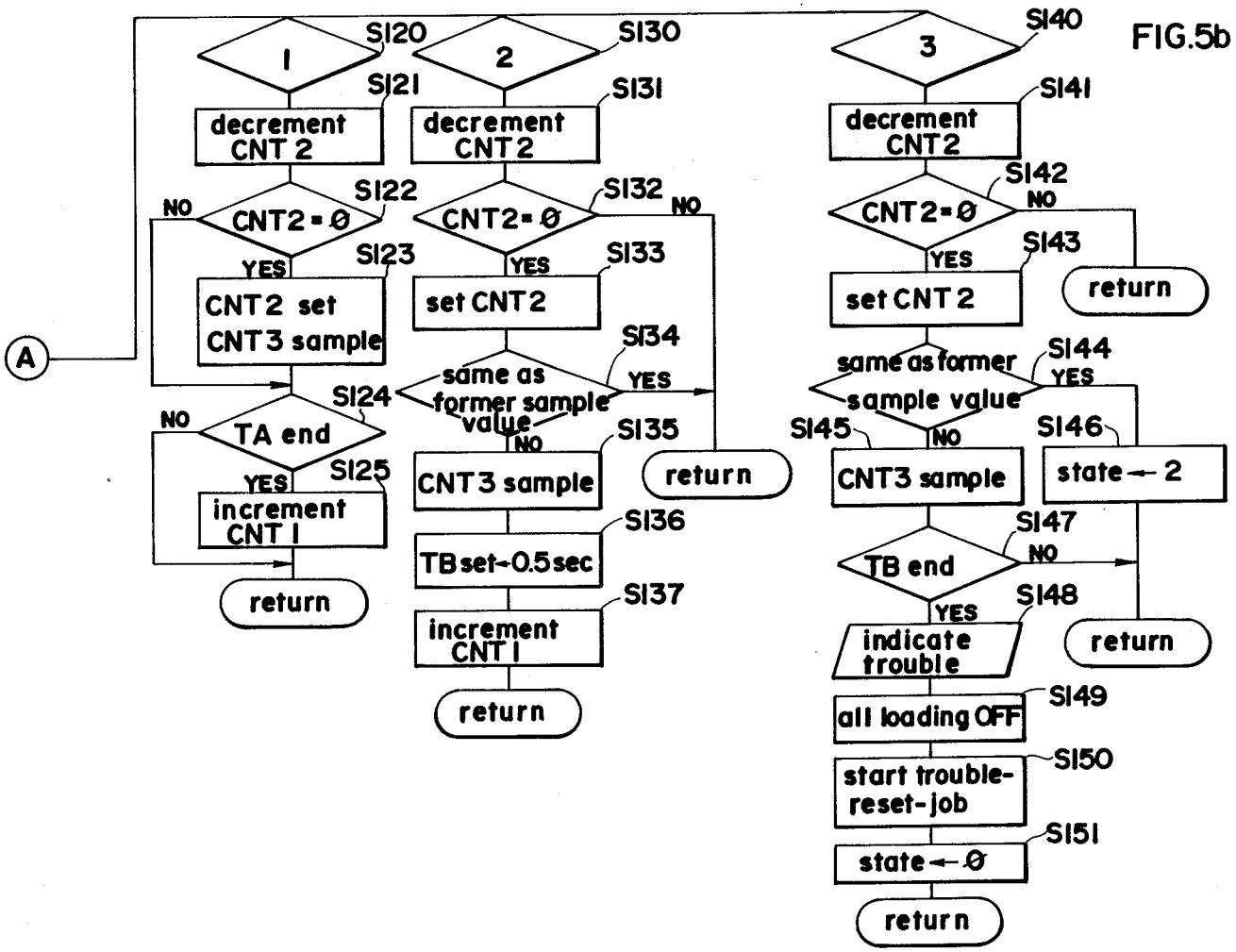
FIG.5b
S120
1
S121
decrement CNT 2
S122
CNT2=Ø
NO
YES
S123
CNT2 set CNT3 sample
S124
TA end
NO
YES
S125
increment CNT 1
return
S130
2
S131
decrement CNT2
S132
CNT2=Ø
NO
YES
S133
set CNT2
S134
same as former sample value
YES
NO
S135
CNT3 sample
S136
TB set-0.5sec
S137
increment CNT 1
return
return
S140
3
S141
decrement CNT2
S142
CNT2=Ø
NO
YES
S143
set CNT 2
return
S144
same as former sample value
YES
NO
S145
CNT3 sample
S146
state ← 2
S147
TB end
NO
YES
S148
indicate trouble
return
S149
all loading OFF
S150
start trouble-reset-job
S151
state ← Ø
return
A

COPYING MACHINE

BACKGROUND OF THE INVENTION

1. Field of the Invention

The present invention relates to a copying machine in which a document is transported to an exposure device to obtain a copy image, and more particularly to a copying machine capable of detecting the trouble of a transporting motor in a document transport stopping mode.

2. Description of the Prior Arts

Conventionally, copying machines have been proposed wherein a document is transported to a fixed exposure device to effect exposure and scanning. An example of these copying machines is constructed such that a document is supported and transported by a transporting roller to effect rapid exposure and scanning.

In the above-mentioned copying machines wherein a document is transported to a fixed exposure device, the document should not be damaged during its transportation. However, the document may be damaged by being transported due to the abnormal operation of the motor for driving the transport roller in a stop mode in which the document should not be transported.

In view of this, a machine has been proposed which is provided with a pulse encoder generating the pulse corresponding to the rotation of the transport roller. In such a machine, troubles which occur during the transportation of the document may be detected by detecting, from the output of the pulse, the presence of the document.

However, when paper jamming occurs, the document transport portion is required to be exposed to remove the jamming document. In this case, the document may wind around the transport roller, with the result that said transport roller is caused to rotate upon the removal of the jamming document.

Therefore, the rotation of the transport roller for the removal of the document cannot be discriminated from that of the roller caused by the abnormal operation of the motor.

SUMMARY OF THE INVENTION

The main object of the present invention is to provide a copying machine of a type in which a document is transported to an exposure device to obtain a copy image, said machine not detecting the operation for removing paper jam and so on as a trouble.

Another object of the present invention is to provide a copying machine of the above-mentioned type wherein the rotation of a motor which should controllably be stopped is not detected as an abnormal operation when a document transport portion is exposed.

These and other objects of the invention can be accomplished by providing a copying machine which comprises a first unit including a platen and image forming means for forming on copy paper an image of a document on said platen; a second unit provided so as to be capable of opening and closing relative to said first unit, said second unit comprising transporting means for transporting the document to said platen and drive means for driving said transporting means; first detecting means for detecting abnormal operation of said driving means; second detecting means for detecting that the second unit is opened; and inhibiting means for inhibiting the operation of said first detecting means in response to said second detecting means.

These and other objects, advantages and features of the invention will become apparent from the following description thereof taken in conjunction with the accompanying drawings which illustrate a specific embodiment of the invention.

BRIEF DESCRIPTION OF THE DRAWING

In the following description, like parts are designated by like reference numbers throughout the several drawings.

FIGS. 5*a* and 5*b* are flow charts showing in detail a first trouble detecting process;

DETAILED DESCRIPTION OF THE PREFERRED EMBODIMENTS

A preferred embodiment of a copying machine embodying the present invention will be explained hereinbelow with reference to the drawings.

Figure 1:
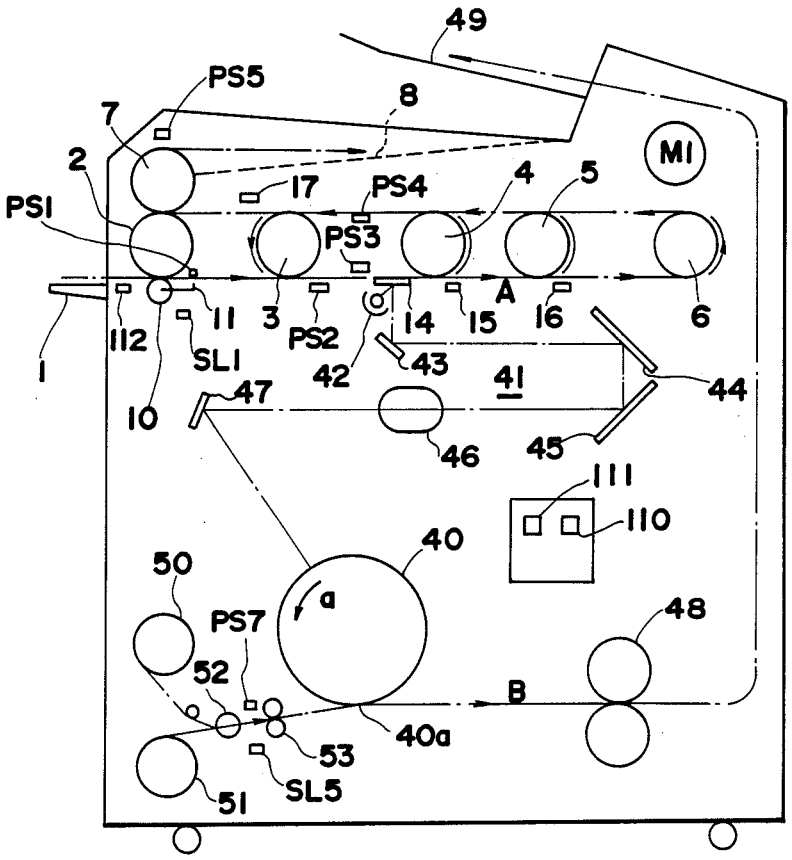
FIG. 1 is a sectional view showing a copying machine according to the present invention.

The present embodiment shows a copying machine in which an inserted document is transported along a predetermined path as shown in FIG. 1. A document transport path, which is formed at the upper portion of the machine main body, is consisted of a document insertion guide plate 1, document transporting rollers 2 to 7, a transporting motor M1 for driving these rollers and a document discharge tray 8. The transporting motor is a DC motor in this embodiment.

A rotatable document insertion roller 10 is provided below the document transporting roller 2 so as to be capable of being in contact therewith or separating therefrom and a stopper 11 is disposed integrally with the document insertion roller 10. The insertion roller 10 and the stopper 11 are driven by a solenoid SL1. Originally, the insertion roller 10 is separated from the transporting roller 2, while the stopper 11 intrudes into the document transport path as shown by one-dot-and-dash line A in FIG. 1. On the other hand, upon the actuation of the solenoid SL1, the insertion roller 10 is in contact with the transporting roller 2 with the stopper 11 receded from the document transport path to thereby make it possible to transport the document.

Each of the transporting rollers 3 to 7 is provided with a guide plate not shown. The transporting rollers 4 and 5 are provided with change-over pawls 15 and 16 respectively for changing over a circulating document transport path and the transporting roller 3 with a change-over pawl 17 for changing over the circulation or discharge of the document. Each change-over pawl 15, 16, 17 is arranged so as to be capable of advancing into or receding from the document transport path shown by one-dot-and-dash line A by a solenoid not shown.

Specifically, the document can be circularly transported along each of the transporting rollers 3 to 7 as guided by each of the guide plates. When the change-over pawl 15 advances into the document transport path with the change-over pawl 17 present on said path, the document is circularly transported between the transporting rollers 3 and 4. In the case where the change-over pawl 16 intrudes into the path with the change-over pawl 17 present thereon, the document is circularly transported between the transporting rollers 3 and 5. If the document is desired to be circularly transported between the rollers 3 and 6, the change-over pawls 15 and 16 are made to be receded from the path with the change-over pawl 17 present thereon. When the change-over pawl 17 recedes from the document transport path, the document is discharged to the discharge tray 8 from the transporting roller 7.

Arranged in the document transport path are photosensors PS1 to PS5 for detecting the document. The sensor PS1 is disposed just before the stopper 11 for detecting the insertion of the document as well as detecting the length of the document in cooperation with a timer, the sensor PS2 for detecting the reference position of the document, the sensor PS3 for starting a timer which detects the length of the document, the sensor PS4 for actuating the change-over pawl 17 and the sensor PS5 for detecting the discharge of the document.

Next, the schematic structure of an image forming portion will be explained hereinbelow.

A photosensitive drum 40 is rotatably driven in the direction of an arrow a. Arranged around the drum are known elements not shown for forming an image such as a charger, developing device and so on. An optical system 41 comprises an exposure lamp 42, mirrors 43, 44, 45, lens 46, and mirror 47. The document is transported on a glass 14 provided between the transporting rollers 3 and 4 to be irradiated by the optical system with light, the reflection of which is slit-exposed on the photosenstive drum 40.

Two kinds of roll type copy paper 50 and 51 are selectively supplied and transported to a transfer portion 40*a* through a cutter 52 driven by a solenoid SL5 and a pair of timing rollers. Copy paper on which an image is transferred at the transfer portion 40*a* is transported as shown by one-dot-and-dash line B in FIG. 1 and effected toner fixation by a fixing device 48. Thereafter, the copy paper is discharged onto the discharge tray 49. Further, a copy paper detecting sensor PS7 is provided immediately before the pair of timing rollers 53.

Figure 2:
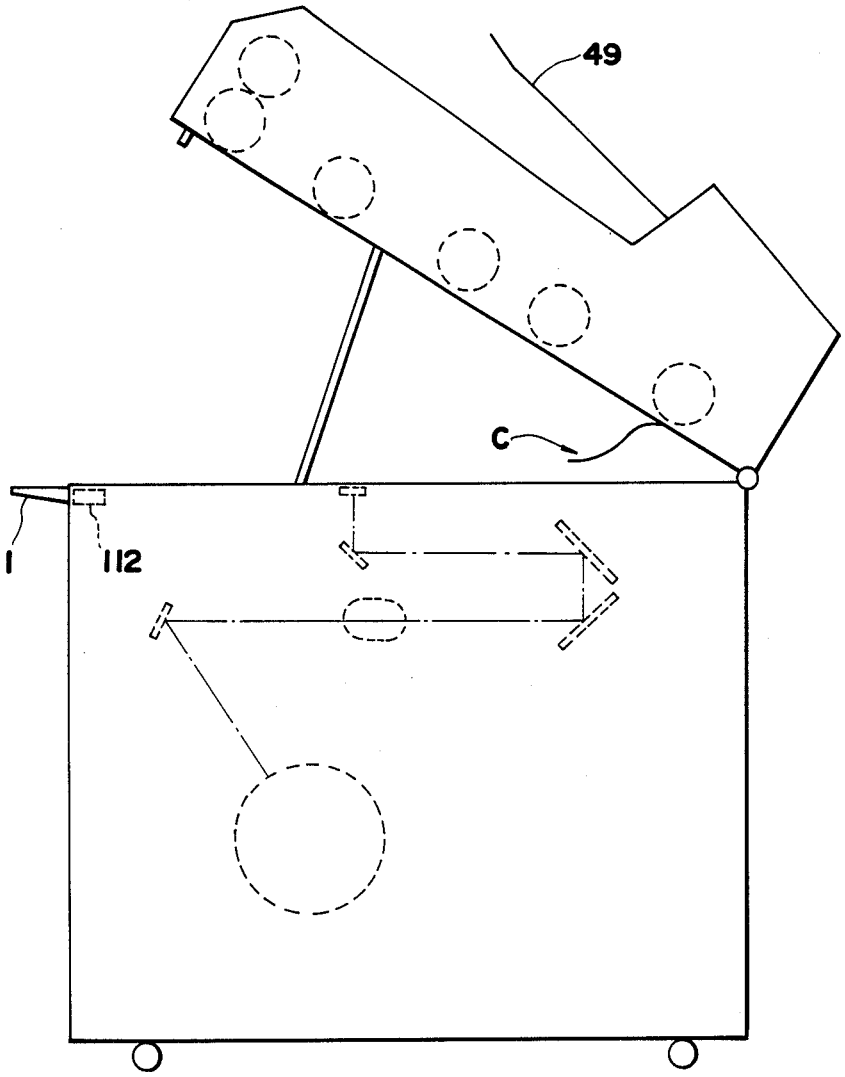
FIG. 2 is a side view showing that an upper portion of the copying machine is held upwardly so as to expose a document transport path.

The copying machine of the present embodiment is separated into two portions, i.e., an upper portion and lower portion. More specifically, the upper portion can be held upwardly with one side thereof supported to be separated from the lower portion as shown in FIG. 2. By this, the doucment transport path inclusive of the transporting rollers 3 to 7 is mostly exposed, with the result that the jamming document C can be removed therefrom.

A switch SW 112 (hereinafter referred to as DH safe SW 112) which is turned ON and OFF according to the opening and closing of the upper portion is arranged in the vicinity of the insertion roller 10.

The copying machine is provided in its inside with switches SW 110 and SW 111, both of which can be operated only when a side door not shown is opened. The switch SW 110 is for not detecting the trouble of the machine. The trouble means the abnormal operation of the machine hereinbelow. For example, this switch SW 110 is a trouble-off-switch employed for operating the machine without detecting troubles in a special state such as in checking the machine when assembling. On the other hand, the switch SW 111 is a trouble-reset-switch. The process executed upon its input will be described later.

Figure 3:
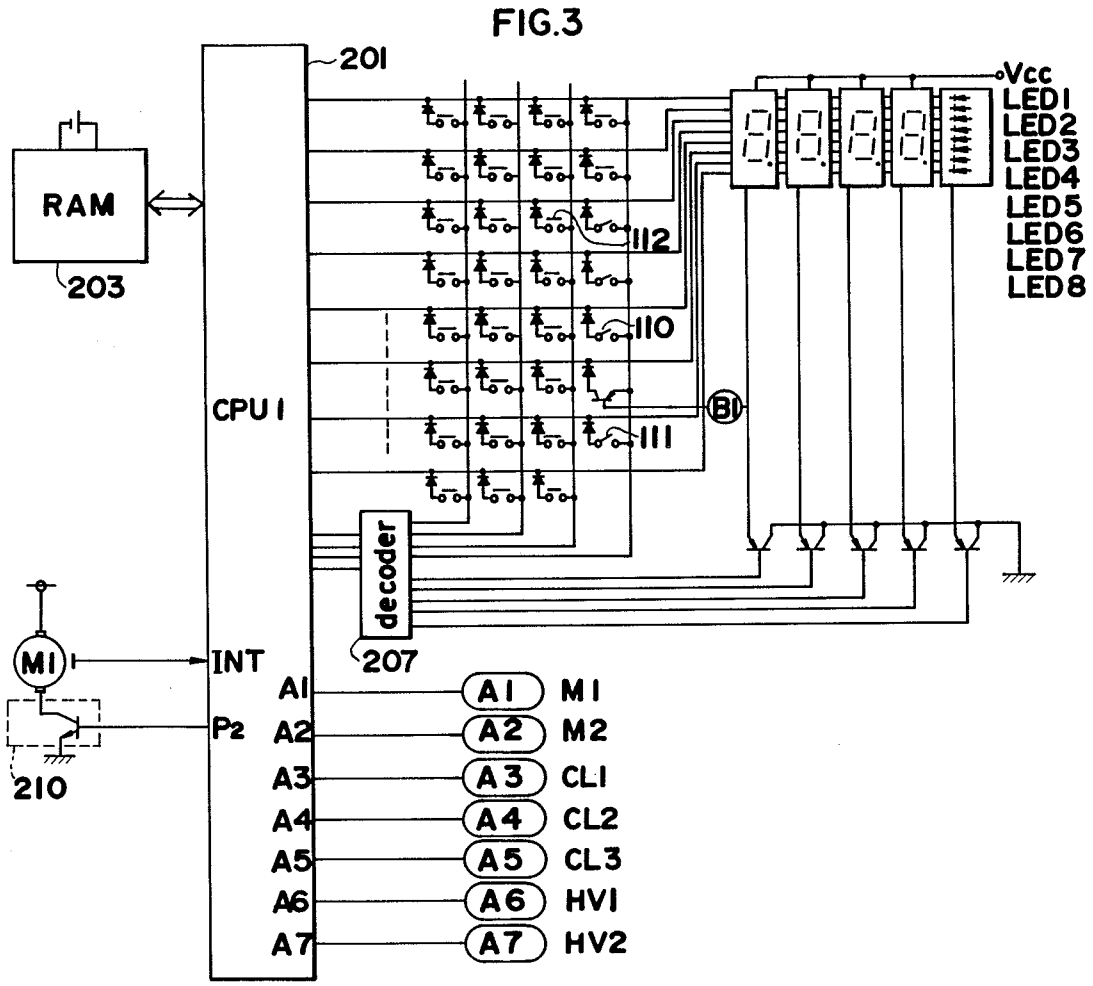
FIG. 3 is a partial view showing a structure of the control portion of the copying machine.

FIG. 3 illustrates a control circuit of the copying machine according to the present invention. The control circuit centrally comprises a first microcomputer 201 for controlling the copying operation and a second microcomputer not shown for controlling the optical system which are interconnected for mutual synchronicity. The first and second microcomputers are communicated with each other via a bus line. The first CPU 201 has a switch matrix 204 connected thereto in a vertical and horizontal arrangement of various operation keys on an operational panel not shown and each type of sensors. An outside RAM 203 which is backed up by a battery stores the data shifted from the ROM of the first microcomputer. Or the RAM 203 is used for writing or reading data concerning other control of the copying machine.

The first CPU 201 has output termninals A1 to A7 connected to a main motor M1, developing motor M2, timing clutch CL1, upper and lower paper feed clutches CL2 and CL3, charger HV1, transfer charger HV2 and the like, said output terminals controlling the ON/OFF status of each component based on the signals from the swtich matrix 204. Additionally, connected to the first CPU 201 via a decoder 207 are various light emitting elements (LEDs) such as a copy number indicator 72, said first CPU 201 controlling the illumination functions of said LEDs.

Further, an output terminal P2 is connected to a drive circuit 210 of the motor Ml for outputting a motor drive signal.

An interruption terminal INT of the first CPUl is connected to a rotary encoder disposed at the non-loaded side of the output axis of the motor M1.

An operation of this machine having the above-mentioned structure will schematically be explained hereinbelow.

The machine body initiates the copying operation when the sensor PS1 detects the insertion of the document from the guide plate 1.

When the sensor PS1 detects the leading edge of the document inserted along the guide plate 1, the solenoid SL1 is made ON, causing that the insertion roller 10 is in pressure contact with the transport roller 2 as well as the stopper 11 recedes from the transport path. By this, the document is transported in the direction of the arrow shown in FIG. 1. When the sensor PS2 detects its leading edge, either of the preselected roll type copy paper 50 or 51 is fed and stopped upon the detection of its leading edge by the sensor PS7.

The document is irradiated on the glass 14 with light by the lamp 42 during its transport to form an electrostatic latent image on the outer surface of the photosensitive drum 40 through the lens 46 or the like. Thus formed latent image is then developed by a developing device not shown to form a toner image. When a predetermined time has been lapsed after the detection of the leading edge of the document by the sensor PS3, a pair of timing rollers 53 is driven to thereby transport copy paper to the transfer portion 40*a* in synchronism with the toner image. Further, copy paper is cut by a length corresponding to that of the document by the cutter 52.

Figure 4:
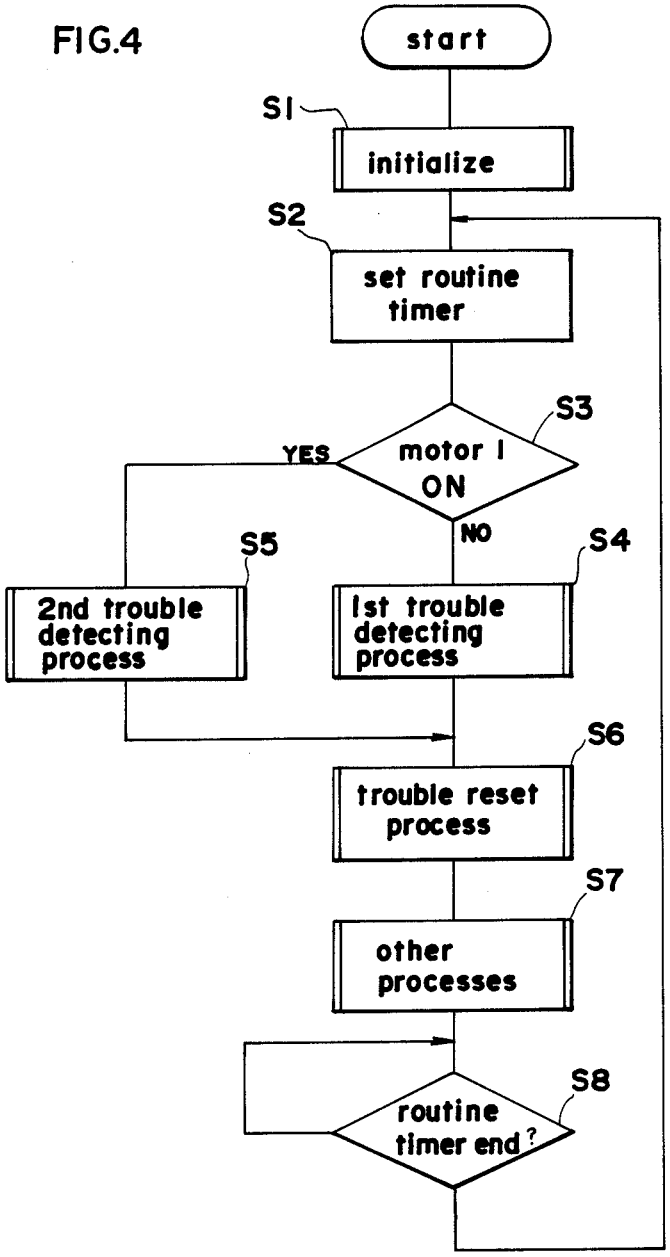
FIG. 4 is a flow chart schematically showing a process performed by a first CPU 201.

FIG. 4 is a flow chart briefly showing the process executed by the first CPU 201.

Step S1 is performed for initialization by intializing various registers. An internal timer for determining the time required for one routine is then started in Step S2. Thereafter, Step S3 judges from the motor drive signal outputted from the output terminal P2 whether the motor M1 is in ON state or not. If it is in OFF state, a first trouble detecting process is executed in Step S4. If in ON state, Step S5 performs a second trouble detecting process.

The subsequent Steps S6 and S7 perform a trouble reset process and other processes respectively. The other processes mean the controls concerning the other copying operation such as the setting of magnification and number of copies, exposure scanning accompanied by the transport of the document, fixation of the toner image, communicating process with the second CPU not illustrated and so on. Then, when the period set by the internal timer has been lapsed in Step S8, one routine job is completely performed with the time for one routine set and returned to Step S2. In this way, the sequence is repeated.

Figure 5A:
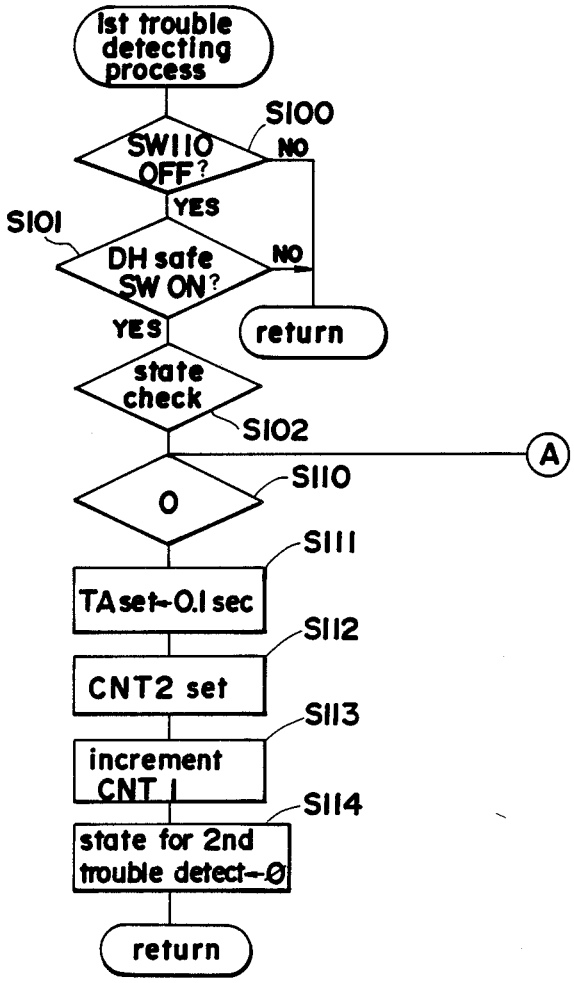

FIGS. 5*a* and 5*b* are flow charts showing in detail the first trouble detecting process executed in Step S4.

Step S100 checks whether the trouble-off-switch SW 110 is OFF or not. If ON, the sequence returns without performing the detection of the trouble. If OFF, Step S101 checks whether the DH safe switch 112 is made ON or not. The OFF state of the DH safe switch 112 means that the document transport path is exposed, so that the sequence returns for preventing that the manual operation for removing the paper jam is not detected as a trouble. If the switch 112 is found to be ON, the sequence proceeds to Step S102 to check a state counter CNT 1.

The state counter CNT 1 carries out the control corresponding to the counter value. The process corresponding to the content of the counter value will be explained.

Step S110 determines whether the state counter CNT 1 is "0" or not, and if "0", a timer TA is set in Step S111. The timer TA, which is for preventing that troubles caused from the transitional pulse input are erroneously detected when the motor is stopped, is adapted to set 0.1 sec for example. Subsequently,a frequency counter CNT 2 is set in Step S112, said frequency counter CNT 2 being for determining the timing at which the number of pulse generated from a pulse encoder connected directly to the output axis of the motor is read out from a pulse counter CNT 3 mentioned later. The low rotating speed of the motor makes the intervals of pulses from the pulse encoder longer, which may produce the case where it is uncertain that one pulse is inputted to one routine of the main routine. Thus, the frequency counter CNT 2 is employed for counting the input of pulses having lower speed than the time required for one routine.

Thereafter, the state of the state counter CNT 1 is incremented in Step S113. On the other hand, the control is executed in Step S114 to return the second trouble detecting process to "0" since the trouble detecting process during ON of the motor is not carried out.

Figure 8:
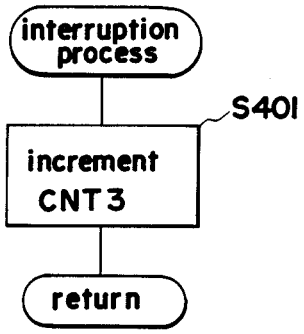
FIG. 8 is a flow chart showing in detail an interruption process.

If the state counter CNT 1 is found to be "1", the frequency counter CNT 2 is decremented in Steps S120 and S121. Specifically, the frequency counter CNT 2 is decremented by one every one routine. Subsequently, a check is made to determine whether the frequency counter CNT 2 is "0" or not in Step S122. If it is "0", the frequency counter CNT 2 is newly set and the value of the encoder pulse counter CNT 3 is sampled. The encoder pulse counter CNT 3 which is formed in RAM 203 performs an interruption process by inputting pulses from the pulse encoder to the interruption terminal to increment the encoder pulse counter CNT 3 as shown in Step S401 in FIG. 8. Further, pulses which are not generated in synchronism with the process executed by the microcomputer and correspond to the rotating amount of the motor can be counted since the encoder pulse counter CNT 3 is counted due to the interruption process. In other words, if the state counter CNT 1 is found to be "1", the frequency counter CNT 2 is decremented every time the main routine is repeatedly performed. The value of the encoder pulse counter CNT 3 is not sampled until the frequency counter CNT 2 set to a predetermined value in Step S112 becomes "0". Then, the state is incremented after the period of time set at the timer TA in Step Slll has been lapsed.

If the state counter CNT 1 is found to be "2" in Step S130, the frequency counter CNT 2 is decremented in Step S131. Step S132 checks whether the frequency counter CNT 2 is "0" or not. If not "0", the sequence returns. If it is "0", the frequency counter CNT 2 is newly set in Step S133 to determine that the value of the frequency counter CNT 2 is the same as the preceding sampling value in Step S134. In other words, Step S134 determines whether the value of the encoder pulse counter CNT 3 is changed or not. If the value is unchanged, i.e., each count value is "0", the sequence is made to return. If the value is not identical with the preceding sampling one, the value of the encoder pulse counter CNT 3 is again sampled in Step S135. Then, the timer TB is set in Step S136. The timer TB is set for removing the influence of noises. More specifically, the timer TB is set by taking the mis-detection into consideration in the case where the value of the encoder pulse counter CNT 3 is changed due to noises. Thereafter, the state is incremented in Step S137.

If the state counter CNT 1 is found to be "3", the frequency counter CNT 2 is decremented in Step S141. Subsequently, Step S142 checks whether the value of the frequency counter CNT 2 is "0" or not. If it is "0", it is initialized in Step S143. If otherwise, the sequence is made to return. Thereafter, a check is made as to whether the value of the encoder pulse counter CNT 3 (see Step S135) is identical with the current value thereof. If the answer is affirmative, the disagreement is determined as a misdetection so that the sequence returns to the state "2" in Step S146. On the other hand, if the value of the encoder pulse counter CNT 3 is not the same as the current one at the time of completion of timer TB, indication is made to indicate that troubles happen in Step S148, and then, all the loading is turned OFF in Step S149. The occurrence of troubles is indicated by lighting LED on an operational panel not shown of the copying machine. Accordingly, the motor comes to a standstill because the power is not supplied thereto, preventing that the document is damaged by operating the document transport path when it should not be operated. As a result, the document can be protected. Additionally, a trouble-reset-job is commenced in Step S150 and the state counter CNT 1 is set to "0" in Step S151. In this case, a trouble state counter CNT 4 concerning the reset of trouble is set to "1" upon actuation of the trouble-reset-job.

Figure 6:
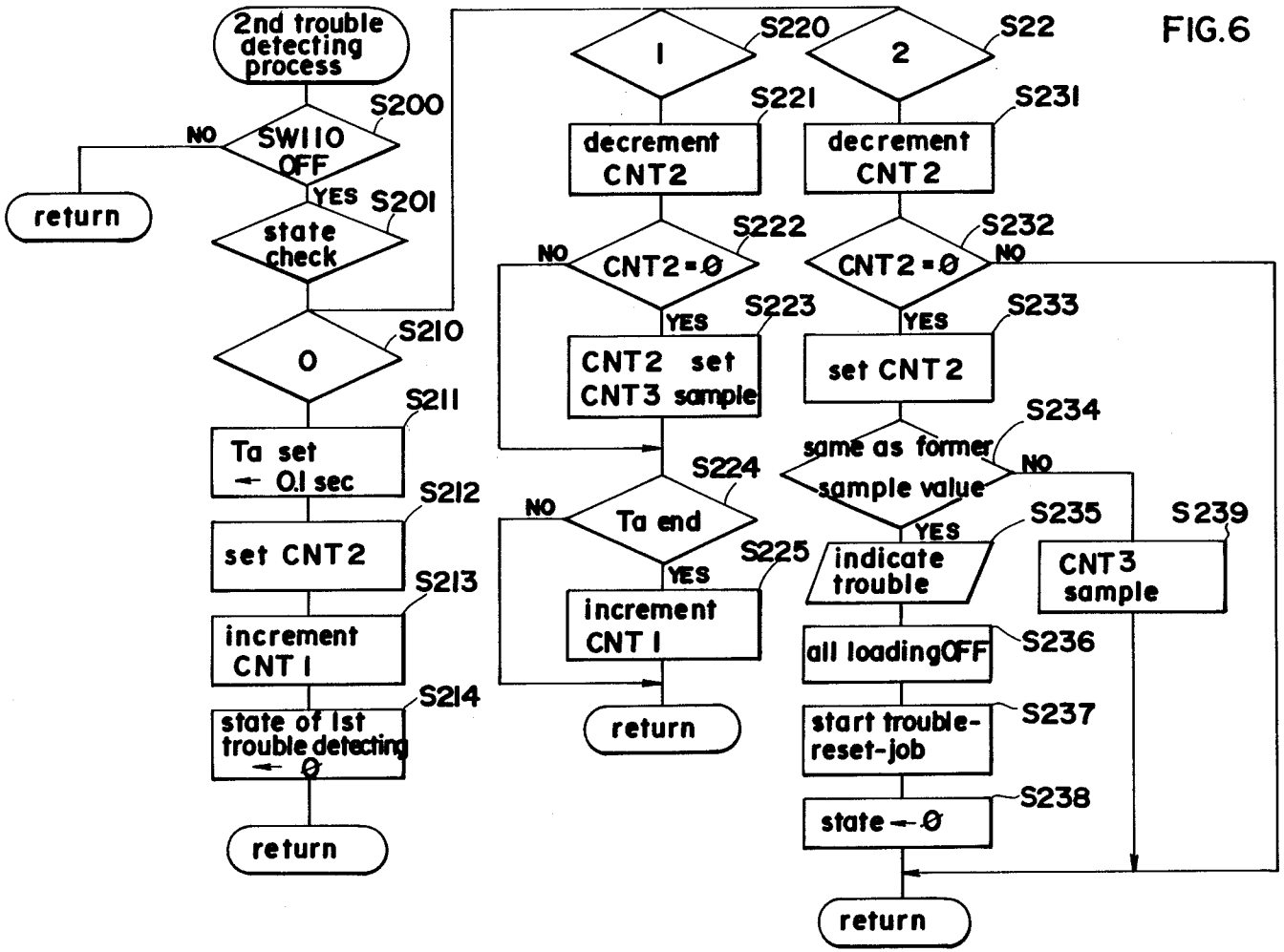
FIG. 6 is a flow chart showing in detail a second trouble detecting process.

FIG. 6 is a flow chart showing in detail the second trouble detecting process performed in Step S5. The processing procedures shown in FIG. 6 are schematically the same as those shown in FIG. 5. In this process, it is judged that troubles are not produced if the number of the encoder pulse changes during the energization of the motor M1.

Step S200 checks whether the trouble-off-switch SW 110 is OFF or not. If it is OFF, the value of the state counter CNT 1 is checked in Step S201.

If the value of the state counter CNT 1 is found to be "0" in Step S210, a timer Ta is set in Step S211. The subsequent Steps S211 to S214 perform respectively such that the frequency counter CNT 2 is set, the value of the state counter CNT 1 is incremented and the state counter CNT 1 of the first trouble detecting process is set to "0".

If the value of the state counter CNT 1 is found to be "1" in Step S220, the frequency counter CNT 2 is decremented in Step S221. The frequency counter CNT 2 is reset when it is judged to be "0" in Step S222 and the value of the encoder pulse is sampled in Step S223. Thereafter, the state is incremented upon completion of the timer Ta (Steps S224 to S225).

If the value of the state counter CNT 1 is found to be "2" in Step S230, the frequency counter CNT 1 is decremented in Step S231. Step S232 checks whether the value of the frequency counter CNT 2 is "0" or not, and if it is "0", the frequency counter CNT 2 is newly set. A check is made in Step S234 as to whether the value of the freqeuncy counter CNT 2 is the same as the former sampling value. The negative answer to Step S234 indicates the normal rotation of the motor, so that the encoder pulse counter CNT 3 is continuously sampled in Step S239. On the other hand, if the value is the same as the former sampling one, it is determined that the motor is stopped driving. Therefore, the subsequent Steps S235 to S238 perform respectively such that the indication is made to indicate that troubles occur, all the loading is turned OFF, the trouble-reset-job is commenced and the state is set to "0".

Figure 7:
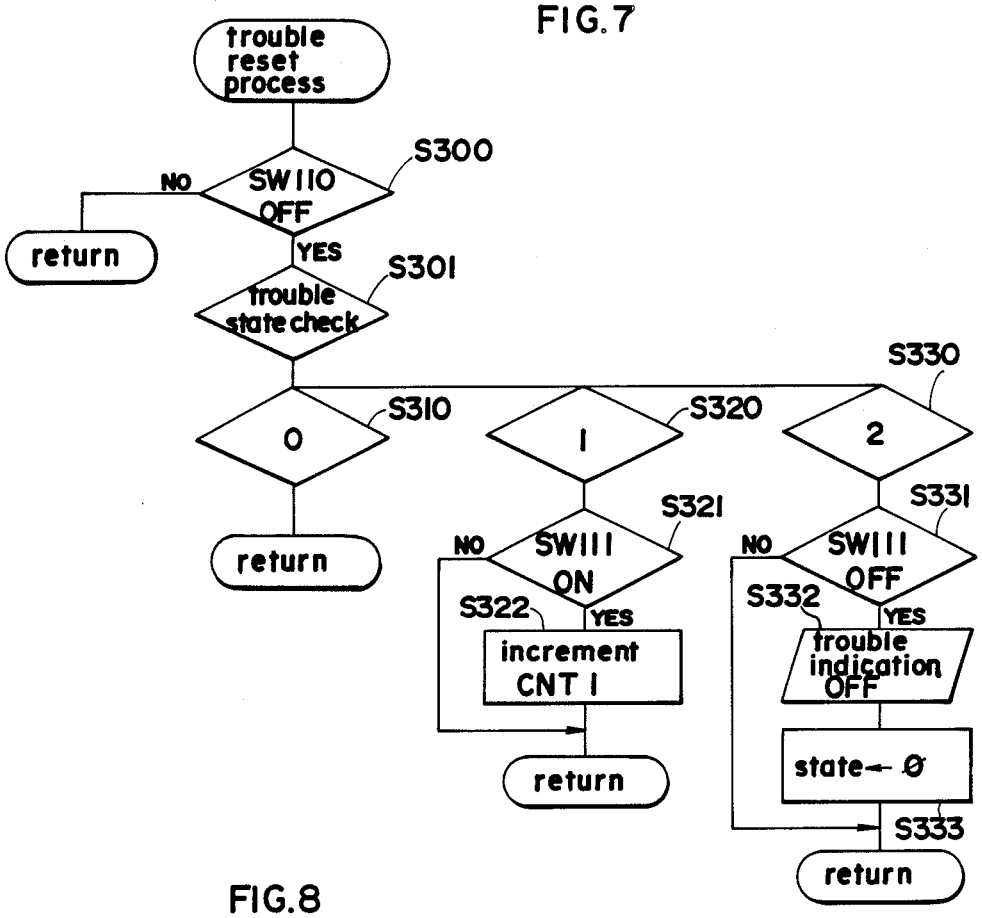
FIG. 7 is a flow chart showing in detail a trouble reset process.

FIG. 7 is a flow chart showing in detail the trouble reset process executed in Step S7.

Step S300 checks whether the trouble-off-switch SW 110 is OFF or not. If it is ON, that is, if the trouble is not detected, the sequence is made to return. If otherwise, Step S301 checks the value of the trouble state counter CNT 4. The value of "0" of the trouble state counter CNT 4 indicates that there is no trouble (Step S310), therefore, the sequence returns. If the value of the trouble state counter CNT 4 is found to be "1" in Step S320, the state is incremented at the ON edge of the trouble-reset-switch SW 111. If Step S330 discovers that the value of the trouble state counter CNT 4 is "2", the indication for indicating the occurrence of the trouble is turned OFF at the OFF edge of the reset switch in Step S332 and the trouble state is set to "0" in Step S333. Specifically, the trouble reset is performed by inputting the switch SW 111 at one time.

Although the present invention has been fully described by way of examples with reference to the accompanying drawings, it is to be noted that various changes and modifications will be apparent to those skilled in the art. Therefore, unless otherwise such changes and modificaitions depart from the scope of the present invention, they should be construed as being included therein.

What is claimed is:

1. A copying machine comprising:

a first unit comprising a platen and image forming means for forming on copy paper an image of a document on said platen;

a second unit provided so as to be capable of opening and closing relative to said first unit; said second unit comprising transporting means for transporting the document to said platen and drive means for driving said transporting means;

first detecting means for detecting abnormal operation of said driving means;

second detecting means for detecting that the second unit is opened; and inhibiting means for inhibiting the operation of said first detecting means in response to said second detecting means.

2. A copying machine as claimed in claim 1 wherein said first detecting means detects the abnormal operation in the case where said driving means is operated at the time when said driving means should not be operated.

3. A copying machine which comprises a driving source and document transport means provided so as to be capable of opening and closing relative to the machine main body, said machine comprising:

means for detecting abnormal operation of said drive source;

means for detecting the opening of said document transport means; and means for inhibiting the operation of said means for detecting abnormal operation of said drive source when the document transport means is opened.

* * * * *